US005230689A

United States Patent [19]

Derby

[11] Patent Number: 5,230,689

[45] Date of Patent: Jul. 27, 1993

[54] METHOD OF MAKING STABILIZED FLEXIBLE CONTAINER FOR FLOWABLE MATERIALS

[75] Inventor: Norwin C. Derby, Dallas, Tex.

[73] Assignee: B.A.G. Corporation, Sherman, Tex.

[21] Appl. No.: 930,358

[22] Filed: Aug. 17, 1992

Related U.S. Application Data

[62] Division of Ser. No. 745,851, Aug. 16, 1991, Pat. No. 5,158,369.

[51] Int. Cl.[5] ..... B31B 1/60

[52] U.S. Cl. ..... 493/210; 493/89; 493/906; 493/217

[58] Field of Search ..... 493/84, 89, 210, 217, 493/226, 906, 908

[56] References Cited

U.S. PATENT DOCUMENTS

| | | | |
|---|---|---|---|
| 1,907,172 | 5/1933 | Arzet . | |
| 2,080,402 | 5/1937 | Herman | 206/41 |
| 2,773,636 | 12/1956 | Williams et al. | 229/55 |
| 3,074,617 | 1/1963 | Kindseth et al. | 229/55 |
| 3,194,471 | 7/1965 | Murphy | 229/14 |
| 3,896,991 | 7/1975 | Kozlowski | 229/55 |
| 3,949,901 | 4/1976 | Tokitz | 222/94 |
| 4,509,643 | 4/1985 | Rhee | 383/119 |
| 4,622,693 | 11/1986 | Mukleby | 383/119 |
| 4,781,475 | 11/1988 | LaFleur | 383/119 |
| 4,898,301 | 2/1990 | Schick | 220/408 |
| 4,903,859 | 2/1990 | Derby et al. | 220/462 |
| 4,909,410 | 3/1990 | Derby et al. | 220/402 |

FOREIGN PATENT DOCUMENTS

| | | | |
|---|---|---|---|
| 0105238 | 10/1985 | European Pat. Off. . | |
| 2437670 | 4/1986 | Fed. Rep. of Germany . | |
| 1392905 | 11/1964 | France . | |
| 2193745 | 7/1972 | France . | |
| 578305 | 6/1958 | Italy . | |
| 0219161 | 2/1968 | Sweden . | |
| 9560 | of 1905 | United Kingdom | 220/DIG. 25 |
| 0953411 | 3/1964 | United Kingdom | 383/121.1 |
| 959306 | 5/1964 | United Kingdom . | |
| 2173169 | 10/1986 | United Kingdom . | |

*Primary Examiner*—William E. Terrell
*Assistant Examiner*—E. Morgan
*Attorney, Agent, or Firm*—Michael A. O'Neil

[57] ABSTRACT

A stabilized flexible container for receiving flowable materials includes a top wall, a bottom wall, and a perimeter wall formed from four double layered side walls seamed together along adjacent side edges. The exterior layer of the double layered side walls is greater in length than the interior layer and is folded inwardly upon itself and stitched along the side edges to form a pocket in a space between the interior and exterior layers of the double layered side wall with the side edges of the exterior layer in the pocket region being free from the seam connecting the adjacent side walls. The interior layers of the side walls are seamed together in the pocket region and are seamed along their bottom edges to the perimeter of the bottom wall. Rigid panels are inserted into the space between the interior and exterior layers of the side walls and are secured in the pocket to prevent the rigid panels from slipping out of the side walls. A separate rigid base may be placed under the containers for additional stability.

9 Claims, 2 Drawing Sheets

METHOD OF MAKING STABILIZED FLEXIBLE CONTAINER FOR FLOWABLE MATERIALS

This is a divisional of co-pending application Ser. No. 07/745,851 filed on Aug. 16, 1991 now U.S. Pat. No. 5,158,369.

TECHNICAL FIELD

This invention relates to flexible containers for receiving flowable materials, and more particularly to a flexible container adapted for stabilization to render the container free-standing and capable of maintaining its shape when filled with a liquid.

BACKGROUND AND SUMMARY OF THE INVENTION

Flexible containers for receiving, transporting, and storing flowable materials have received wide acceptance due to substantial cost savings. Flexible containers are much more cheaply produced and are more easily and economically stored when not in use than are rigid containers such as drums and boxes. Despite the wide acceptance of flexible containers, problems exist in their use. Unlike rigid containers, the flexible containers do not retain their desired shape when filled with flowable materials, thus, making transportation and storage of the filled containers less convenient than with rigid containers. Failure of the flexible containers to retain the desired squared shape is a particular problem when the containers are filled with liquids. Liquids tend to flatten the containers into a pillow shape, making it difficult to maintain the containers in an upright position.

In an attempt to overcome the problems associated with flexible containers, flexible semi-bulk containers utilizing rigid panels associated with the side walls of the containers were developed. The rigid panels provided rigidity to the containers enabling the containers to stand alone when filled with fluidized materials. Although the containers having the rigid panels are sufficiently rigid to enable the container to stand alone, the containers are not as easily stored as the flexible containers without panels, nor do they have as long a life due to the possibility of damage to or failure of the rigid panels. Additionally, at least two of the rigid panels are required to be scored so that the container may be folded for storage. Once the rigid panels have been folded along the score lines the panels are less likely when filled to retain the desired rigid square shape.

In most instances, the rigid panels are glued to the side walls of the flexible container. If a panel is damaged or fails, it is difficult to remove and replace the damaged panel. In the event the panels are not glued to the container side walls, the panels tend to fall or slide out of the containers.

A container incorporating the present invention overcomes the foregoing and other problems through use of removable rigid panels. The panels are inserted into double layered side walls of the container and are held in position by a pocket formed in the lower edge of one of the layers of the double wall. Thus, the panels do not have to be glued to the side walls of the container making removal easy for replacing damaged panels or folding and storing the container when not in use. Because the panels are removable, they do not need to be scored. Therefore, the panels are stronger than scored panels and allow the container to maintain more of a square shape. For added stability and protection a shallow, rigid tray is placed under the container. Thus, the containers continue to be economically produced, more cheaply stored, retain a square shape when filled with fluidized materials, and experience a longer life than prior art containers.

BRIEF DESCRIPTION OF THE DRAWINGS

For a more complete understanding of the present invention and the advantages thereof, reference is now made to the following Detailed Description taken in conjunction with the accompanying Drawings in which.

DETAILED DESCRIPTION OF THE INVENTION

Figure 1:
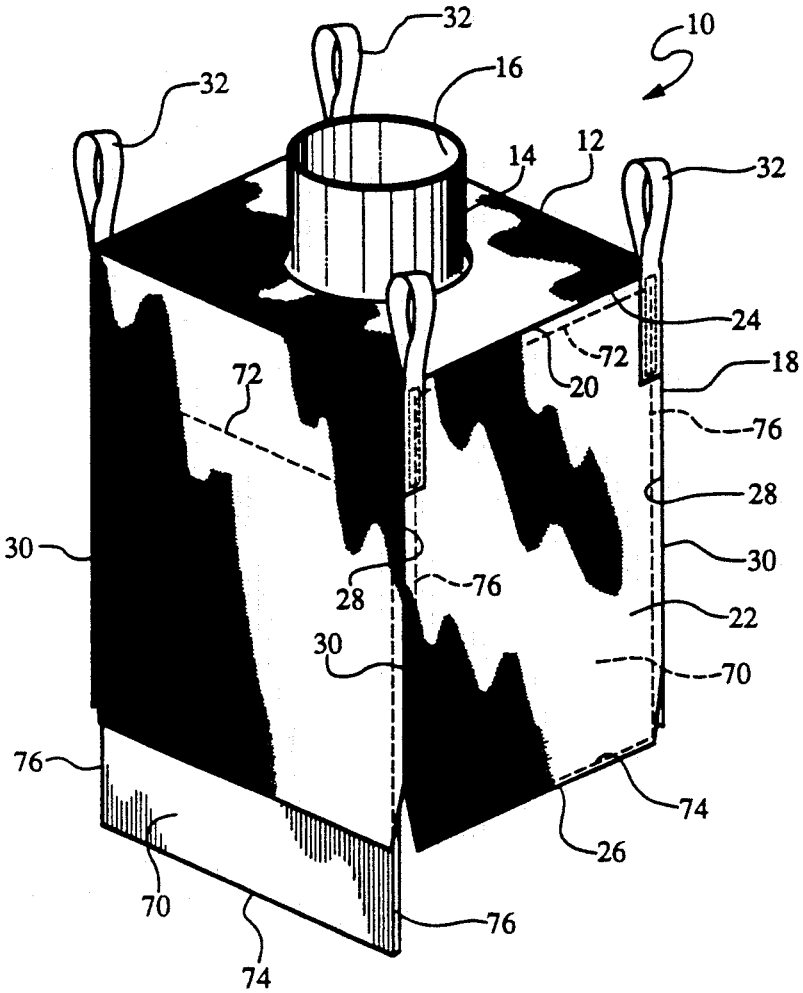
FIG. 1 is a perspective view of a stabilized flexible container of the present invention showing insertion of a rigid panel for stability.

Referring now to the Drawings, and particularly to FIG. 1, there is shown a stabilized container 10 of the present invention. A top wall 12 of the container 10 has an opening, 14 in the center thereof for insertion of a co-extruded plastic film liner having closeable fill and/or discharge spouts therein for receiving, holding, or discharging a liquid or spout 16 therethrough for receiving or discharging flowable materials into or from the container 10. A perimeter side wall 18 is attached to the top wall 12 at a seam 20 along the perimeter of the top wall 12.

Four double layered side walls 22, each having a top edge 24, a bottom edge 26 and two side edges 28 are connected together along their side edges 28 by a side seam 30 to form the perimeter side wall 18. Lift straps 32 by the side walls 22 at the side edges 28 near the top edge 24 of the side walls 22 such that the center portion of the lift straps 32 extends above the seam 20 connecting the top wall 12 to the perimeter side wall 18.

Figure 2:
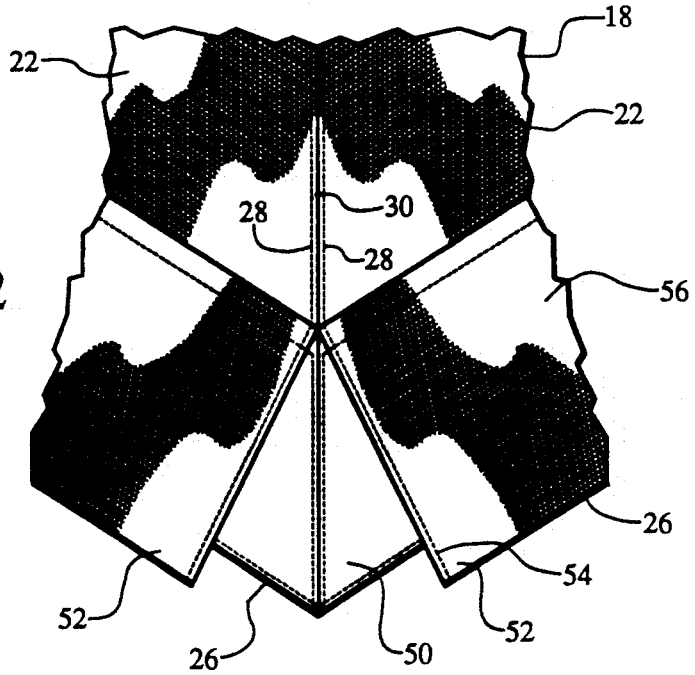
FIG. 2 is a detailed illustration of the construction of the pocket portion of the lower exterior side wall of the container of FIG. 1.

Referring now to FIG. 2, the double layered side walls 22 have an inner or interior layer 50 and an exterior layer 52. As shown in detail in FIG. 2, the interior layer 50 and exterior layer 52 are attached to one another along the side edges 28 of the side wall 22 at the seam 30 connecting the side edges 28 of the side walls 22 to form the perimeter side wall 18. Both the interior layer 50 and the exterior layer 52 of the side walls 22 are caught in the seam 20 connecting the perimeter side wall 18 and the top wall 12. The exterior layer 52 is greater in length than the interior layer 50. The additional length of the exterior layer 52 is folded back on itself and stitched in place along a stitching line 54 near the side edge 28 of the side wall 22, thus, forming a pocket 56 along the bottom edge 26 of the exterior layer 52 of the side wall 22.

Figure 3:
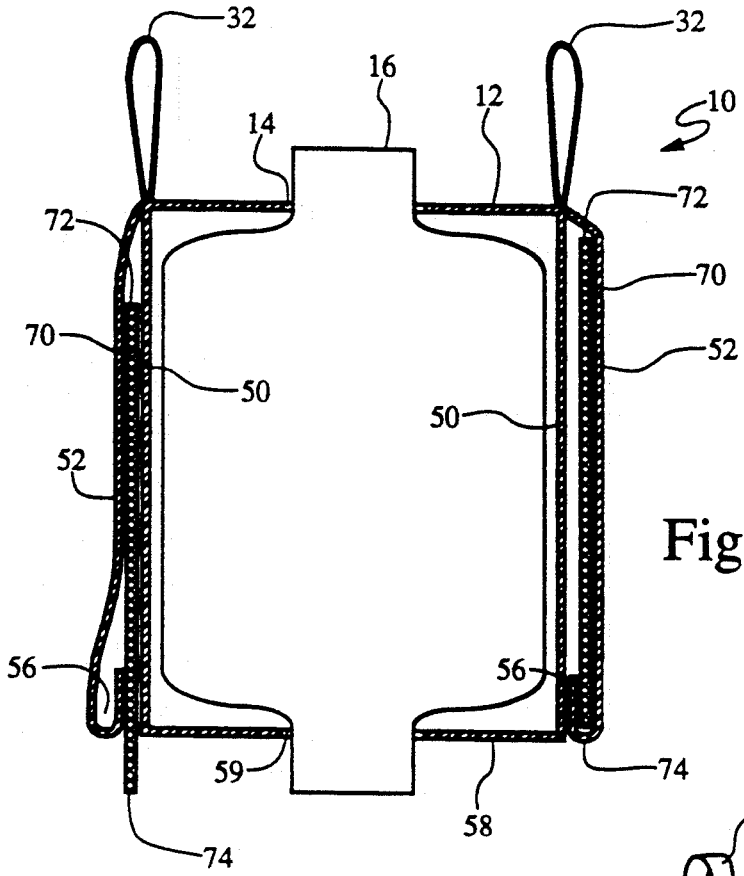
FIG. 3 is a longitudinal section view of the container of FIG. 1.

The interior layer 50 of the side wall 22 is stitched along the bottom edge 26 to a bottom wall 58, as shown in FIG. 3, of the container 10. The interior layers 50 of the side walls 22 are stitched to one another at the side seam 30 with the pocket 56 portion of the exterior layer 52 remaining free from the side seam 30. The bottom wall 58 has an opening 59 in the center thereof for filling or emptying the container and for insertion of the co-extruded liner or spout 16 therethrough.

To stabilize the container, rigid panels 70 are inserted between the interior layer 50 and exterior layer 52 of the side walls 22, as shown in FIGS. 1 and 3. The panels as shown in partial broken lines in FIG. 1, have a top edge 72, a bottom edge 74, and side edges 76. When inserted into the double layered side walls 22, the bottom edges 74 of the rigid panels 70 are placed into the pockets 56 to prevent the rigid panels from slipping out of the side walls 22. Thus, when the rigid panels 70 are placed into the double layered side walls 22 the container is given a rigid angular configuration making the container free-standing and retaining the shape of the container when filled with flowable materials. Easy insertion and removal of the panels 70 allow the flexible container 10 to be easily folded and stored, prevent damage to the panels while the container is empty, and allow for easy replacement of a damaged panel, thereby extending the life of the container. Thus, use of the container 10 facilitates more efficient and stable stacking of the containers, improved use of floor space for transportation and storage, and maintains the containers in an upright position when they are filled with liquids.

Figure 4:
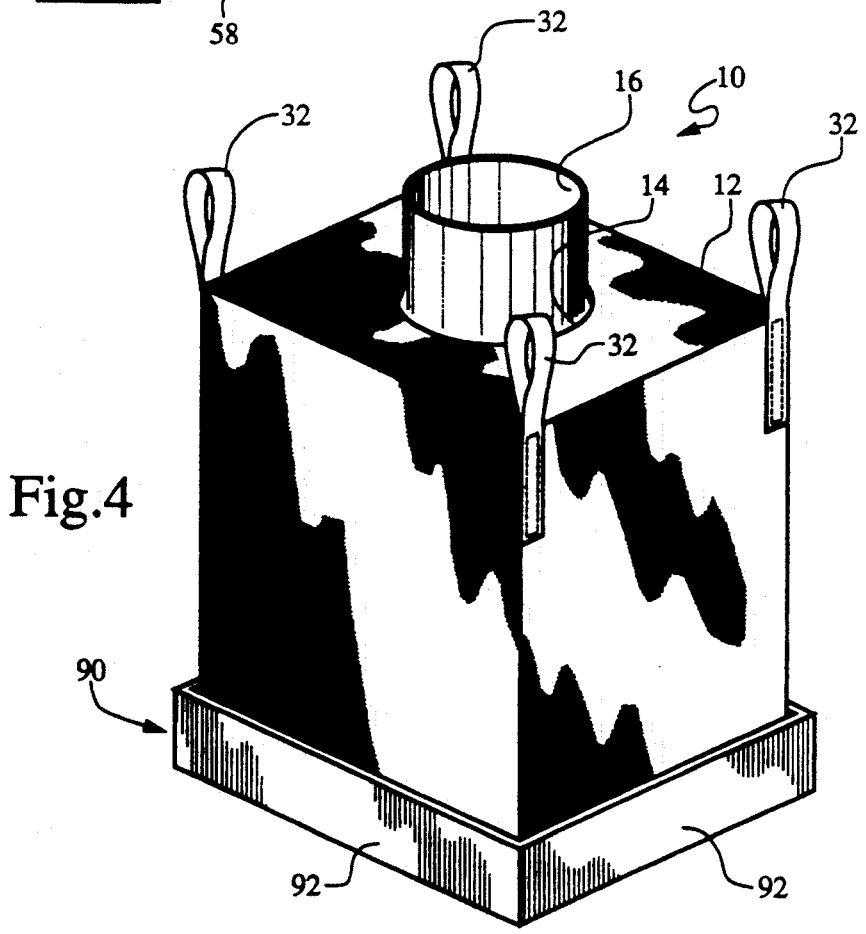
FIG. 4 is a prospective view of the container of FIG. 1 supported in a rigid base.

When filled containers 10 are stored either on a flat surface or on a slatted pallet, the bottom wall 58 of the container 10 may be damaged by lifting equipment as the containers are moved about for transportation or storage and when being stacked for storage. As shown in FIG. 4, to add further stability to the container 10 and to avoid damage to the bottom wall 58, a rigid base 90 having a bottom wall and four shallow side walls 92 ma be placed under the container 10. The base 90 receives the container 10 to add further stability to the container 10 as well as limiting damage to the top edges 72 and the bottom edges 74 of the rigid panels 70 when the containers are stacked vertically. As with the rigid panels 70, the base 90 may be easily stored when the container 10 is not being used and may be easily replaced if damaged, further increasing the useful life of the container 10.

To construct the container 10, the lower edge 26 of the exterior layer 52 of the side walls 22 is turned up on itself and stitched near the side edges 28 along the stitching line 54 to form a pocket 56. The exterior layers 52 are then seamed to the interior layers 50 beginning at the top edges 24 and extending along the side edges 28 to the point where the pocket 56 of the exterior layer 52 begins, thus forming the double layered side walls 22. The double layered side walls 22 are then connected along the side edges 28 by the seam 30 with the pocket portion 56 of the exterior layer 52 being kept free from the seam 30. The top edges 24 of the side walls 22 are then stitched to the perimeter of the top wall 12 with both the interior layer 50 and the exterior layer 52 of the side walls 22 being caught in the seam 20 connecting the side walls 22 and the top wall 12. The lower edges 26 of the interior layer 50 of the side walls 22 is seamed to the bottom wall 58. The lift straps 32 may be attached to the side walls 22 at any point in the manufacturing process.

Although preferred embodiments of the invention have been illustrated in the accompanying Drawings and described in the foregoing Detailed Description, it will be understood that the invention is not limited to the embodiments disclosed, but is capable of numerous rearrangements and modifications of parts and elements without departing from the spirit of the invention.

I claim:

1. A method for manufacturing a flexible semi-bulk material container for stabilizing when filled with a flowable material so as to enable the filled container to stand alone, said method comprising the steps of:

providing four exterior side wall panels having two opposed side edges, a top, and a bottom edge;

folding the bottom edges of each exterior panel upwardly and stitching the folded portion to the exterior panel along the side edges to form an upwardly opening pocket in the bottom edge of each exterior panel;

pairing the four exterior side wall panels with four corresponding interior side wall panels to form double-layered panels having a space between the interior and exterior panels such that the pockets in the bottom edges of the exterior panels open into said space;

stitching the double-layered side wall panels together along adjacent side edges to form a double-layered perimeter side wall;

stitching the top edges of the double-layered perimeter side wall to a top wall along its perimeter;

stitching the bottom edges of the interior side wall panels to a bottom wall along its perimeter;

inserting rigid panels into the spaces between the interior and exterior panels of at least two opposed double-layered side wall panels such that the rigid panels rest in the pockets in the bottom edges of the exterior side wall panels to retain the rigid panels in place for providing rigidity sufficient to impart adequate stability to the side wall of the container to enable it to stand alone on the bottom wall when filled with flowable material.

2. The method for manufacturing a container of claim 1, further comprising the step of inserting a rigid panel in each space between the interior and exterior panels of each of the four double-layer side wall panels.

3. The method for manufacturing a container of claim 1, further comprising the step of forming an access spout in the top wall to fill and empty the container with flowable materials.

4. The method for manufacturing a container of claim 1, further comprising the step of forming access spouts in the top wall and bottom wall for filling and emptying the container of flowable materials,

5. The method for manufacturing a container of claim 1, further comprising the step of inserting a liner of co-extruded plastic film having a closeable fill and discharge spout therein for receiving and discharging a liquid into the inside of said container for holding the liquid in said stabilized container.

6. The method for manufacturing a container of claim 1, further comprising the step of forming a separate rigid base having a bottom and four sides for receiving and supporting the bottom wall of the container.

7. A method for stabilizing a flexible semi-bulk material container when filled with a flowable material so as to enable the filled container to stand alone, said method comprising the steps of:

providing four exterior side wall panels having two opposed side edges, a top, and a bottom edge;

folding the bottom edges of each exterior panel upwardly and stitching the folded portion to the exterior panel along the side edges to form an upwardly opening pocket in the bottom edge of each exterior panel;

pairing the four exterior side wall panels with four corresponding interior side wall panels to form double-layered panels having a space between the interior and exterior panels such that the pockets in the bottom edges of the exterior panels open into said space;

stitching the double-layered side wall panels together along adjacent side edges to form a double-layered perimeter side wall;

stitching the top edges of the double-layered perimeter side wall to a top wall along its perimeter;

stitching the bottom edges of the interior side wall panels to a bottom wall along its perimeter;

inserting rigid panels into the spaces between the interior and exterior panels of at least two opposed double-layered side wall panels such that the rigid panels rest in the pockets in the bottom edges of the exterior side wall panels to retain the rigid panels in place for providing rigidity sufficient to impart adequate stability to the side wall of the container to enable it to stand alone on the bottom wall when filled with flowable material; and forming access spouts in the top panel and the bottom panel for filling and emptying the container.

8. The method of manufacturing a container of claim 7, further comprising the steps of:

inserting a liner of co-extruded plastic film having a closeable fill and discharge spout therein for receiving and discharging a liquid into the inside of said container for holding the liquid in said stabilized container.

9. The method for manufacturing a container of claim 7, further comprising the step of forming a separate rigid base having a bottom and four sides for receiving and supporting the bottom wall of the container.

* * * * *